US005381214A

United States Patent [19]

Kumon et al.

[11] Patent Number: 5,381,214

[45] Date of Patent: Jan. 10, 1995

[54] ELECTROPHOTOGRAPHIC CHARGING DEVICE

[75] Inventors: Akira Kumon, Katano; Katsutoshi Ogawa, Hirakata; Masaichiro Tatekawa, Mino; Hitoshi Hisada, Toyonaka; Junichi Nawama, Moriguchi; Noboru Katakabe, Uji; Masahiro Aizawa, Takatsuki, all of Japan

[73] Assignee: Matsushita Electric Industrial Co., Ltd., Osaka, Japan

[21] Appl. No.: 48,514

[22] Filed: Apr. 20, 1993

[30] Foreign Application Priority Data

Apr. 20, 1992 [JP] Japan ..... 4-099158
Jun. 15, 1992 [JP] Japan ..... 4-154641

[51] Int. Cl.[6] ..... G03G 15/02

[52] U.S. Cl. ..... 355/219; 250/325; 355/221; 361/221

[58] Field of Search ..... 355/221, 219, 225, 296, 355/297; 361/225, 230, 235, 221; 250/325, 324, 326

[56] References Cited

U.S. PATENT DOCUMENTS

| | | | |
|---|---|---|---|
| 3,146,385 | 8/1964 | Carlson . | |
| 3,911,335 | 10/1975 | Takahashi | 250/324 X |
| 4,203,144 | 5/1980 | Okamoto | 361/234 |
| 4,724,509 | 2/1988 | Bergen et al. | 361/230 |
| 5,010,441 | 4/1991 | Fox et al. | 361/221 |
| 5,028,779 | 7/1991 | Gundlach et al. | 355/221 X |
| 5,241,342 | 8/1993 | Asano et al. | 355/219 |
| 5,243,387 | 9/1993 | Ikegawa | 355/219 |
| 5,324,942 | 6/1994 | Mishra et al. | 250/260 |

FOREIGN PATENT DOCUMENTS

| | | |
|---|---|---|
| 0431559A3 | 6/1991 | European Pat. Off. . |
| 61-83559 | 4/1986 | Japan . |
| 4-20986 | 1/1992 | Japan . |
| 4-21873 | 1/1992 | Japan . |

*Primary Examiner*—A. T. Grimley
*Assistant Examiner*—Thu A. Dang
*Attorney, Agent, or Firm*—Wenderoth, Lind & Ponack

[57] ABSTRACT

A charging member for charging a photosensitive member from above toner in an electrophotographic process in which charging, exposure, development, and transfer steps are performed repeatedly and in which a step of cleaning toner remaining on a photosensitive member is eliminated, the charging member including: an electrically conductive charging wire which is disposed in contact with the photosensitive member; the charging wire forming an angle of less than 90° with a direction of a rotational axis of the photosensitive member and is arranged at an interval in the direction of the rotational axis of the photosensitive member; and a power source for applying a pulse voltage to the charging wire, the pulse voltage having a polarity identical with that of the toner so as to vibrate the toner.

8 Claims, 4 Drawing Sheets

ELECTROPHOTOGRAPHIC CHARGING DEVICE

BACKGROUND OF THE INVENTION

The present invention relates to a charging device for use in an electrophotographic type copying apparatus, facsimile machine, printer or the like.

Conventionally, a corona charger is employed as the charging device foe use in the electrophotographic type copying apparatus, facsimile machine, printer or the like. In the known corona charges, a wire of 50 to 100 μm in diameter is extended in a metal shield having a mouth portion confronting a photosensitive member so as to be spaced several to 10 mm from a surface of the photosensitive member. A high voltage of 5 to 6 kV is applied to the wire so as to generate an electric charge. The surface potential of the photosensitive member is controlled by providing a grid electrode capable of applying a voltage between the mouth portion and the photosensitive member. In case the known corona charger is employed, a large quantity of ozone is produced, thereby resulting in a deterioration of the photosensitive member and other peripheral members made of rubber or plastics. Meanwhile, the corona charger itself is contaminated by a product produced by generation of ozone and maintenance operations such as cleaning are required to be performed.

Meanwhile, U.S. Pat. No. 4,851,960 discloses a contact type charging method which reduces the quantity of generated ozone. An elastic and electrically conductive roller is depressed against a surface of a photosensitive member and DC voltage or combination of AC voltage and DC voltage is applied to the roller so as to generate a discharge in a minute gap defined between the surface of the photosensitive member and that of the roller in the vicinity of a point of contact therebetween such that the photosensitive member is electrically charged. However, in this method, the surface of the roller is contaminated by toner, etc. which have passed through a cleaning device for the photosensitive member. Thus, a problem arises in that due to a drop of the charging capability of the roller, a blank portion of a copy is dirtied.

SUMMARY OF THE INVENTION

Accordingly, an essential object of the present invention is to provide a charging member in an electrophotographic charging device which prevents production of ozone and eliminates a cleaning device for a photosensitive member in an electrophotographic apparatus so as to make the electrophotographic apparatus compact such that the photosensitive member can be electrically charged even in a state where toner adheres to the photosensitive member.

The object of the present invention can be effected by providing a charging member for charging a photosensitive member from above toner in an electrophotographic process in which charging, exposure, development, and transfer steps are performed repeatedly and in which a step of cleaning the toner remaining on the photosensitive member after the transfer step is eliminated, the charging member consisting: an electrically conductive charging wire which is disposed in contacted with the photosensitive member; wherein the charging wire forms an angle of less than 90° with a direction of a rotational axis of the photosensitive member and is arranged at an interval in the direction of the rotational axis of the photosensitive member; and wherein a pulse voltage having a polarity identical with that of the toner is applied to the charging wire so as to vibrate the toner. Discharge is generated in a minute gap defined between the photosensitive member and the charging wire in the vicinity of a point of contact therebetween so as to charge the photosensitive member. In order to prevent leaking into pin holes of the photosensitive member, the charging wire may be formed with an insulating coating layer or a resistor for preventing local leakage may be connected between the charging member and the power source. Alternatively, the wire sections may be separated from each other so as to prevent local leakage.

In an electrophotographic process, after charging of the photosensitive member, image exposure, development by the toner and transfer to a copy paper sheet, residual toner on the photosensitive member is removed by cleaning. The removed toner is discarded as waste toner. By using the charging device of the present invention, the cleaning device can be eliminated from the electrophotographic apparatus. The residual toner after transfer is carried to the charging device so as to be shifted from the original position by the wire sections set to an angle less than 90° relative to the axial direction of the photosensitive member and at the same time, the surface of the photosensitive member is charged by the charging wire.

By the above mentioned arrangement of the charging device of the present invention, the photosensitive member can be charged without generation of harmful ozone and a cleaning device can be eliminated from an electrophotographic apparatus. Furthermore, the charging device eliminates waste toner from the electrophotographic apparatus, which is preferable from a standpoint of environmental protection.

BRIEF DESCRIPTION OF THE DRAWINGS

This object and features of the present invention will become apparent from the, following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
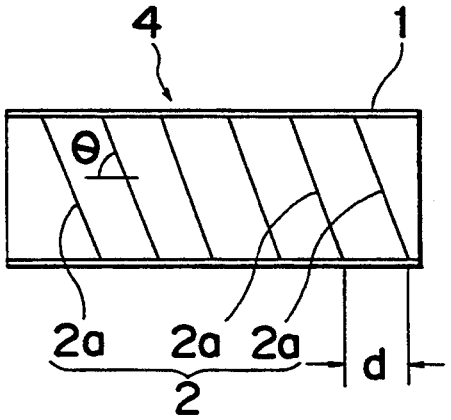
FIG. 1 is a front elevational view of a charging member employed in a charging device according to one embodiment of the present invention.
Figure 2:
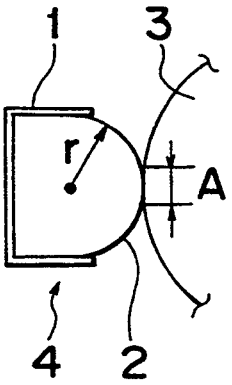
FIG. 2 is a side elevational view of the charging member of FIG. 1.

Referring now to the drawings, there is shown in FIGS. 1 and 2, a charging member 4 employed in a charging device K according to one embodiment of the present invention. The charging member 4 includes an electrically conductive support member 1 and a charging wire 2. As shown in FIGS. 1 and 2, the charging wire 2 is formed into a plurality of wire sections 2*a* which form an angle $\theta$ with an axial direction of a photosensitive drum 3 and are arranged at a proper interval d in the axial direction of the photosensitive drum 3 so as to be brought into contact with a surface of the photosensitive drum 3. As shown in FIG. 2, the charging wire 2 is secured to the support member 1 such that an arcuate portion of each of the wire sections 2*a* is brought into contact with the surface of the photosensitive drum 3. The angle$\theta$ desirably is less than 90° and more desirably ranges from 60° to 80°. Meanwhile, the interval d preferably ranges from 0.2 to 6 mm and more preferably ranges from 1 to 5 min.

The charging wire 2 is formed by an electrically conductive wire and is made of (1) a metal such as tungsten, aluminum, copper and stainless steel, (2) a synthetic fiber in which carbon or carbon fiber is scattered or is laminated around a core. Amorphous material including an amorphous metal such as cobalt and an amorphous nonmetal such as amorphous carbon is more preferable for the charging wire 2 than a material having a high crystallinity. The charging wire 2 may be formed by combining or knitting these materials. Furthermore, the charging wire 2 may be formed by a bundle of a plurality of, for example, several thousand wires. The electric resistance of the charging wire 2 should not exceed $10^9\Omega$.

The support member 1 is made of metal such as aluminum, iron, copper and zinc or an insulating resin in which the volume resistivity is adjusted to about $10^6$ to $10^{10}$ $\Omega$.cm by scattering an electrically conductive filler therein.

In this embodiment, the charging wire 2 is formed by a bundle of 45 wires which each have a diameter of 15 $\mu$m and are made of amorphous cobalt. The interval d is set to 3 mm. As shown in FIG. 2, the charging wire 2 is secured to the support member 1 so as to be formed into a semicircular shape having a radius r and is brought into contact, at a region A, with the photosensitive drum 3 to be charged. The radius r of the semicircular shape of the charging wire 2 ranges from 1 to 10 mm in this embodiment and preferably is 3 mm. Width of the contact region A of the charging wire 2 depends on relative speed between the charging wire 2 and the photosensitive drum 3. When the photosensitive drum 3 is rotated at a speed of 15 to 30 mm/sec. so as to be charged in this embodiment, the width of the contact region A of the charging wire 2 preferably ranges from 0.5 to 15 mm and more preferably is about 3 mm.

Figure 3:
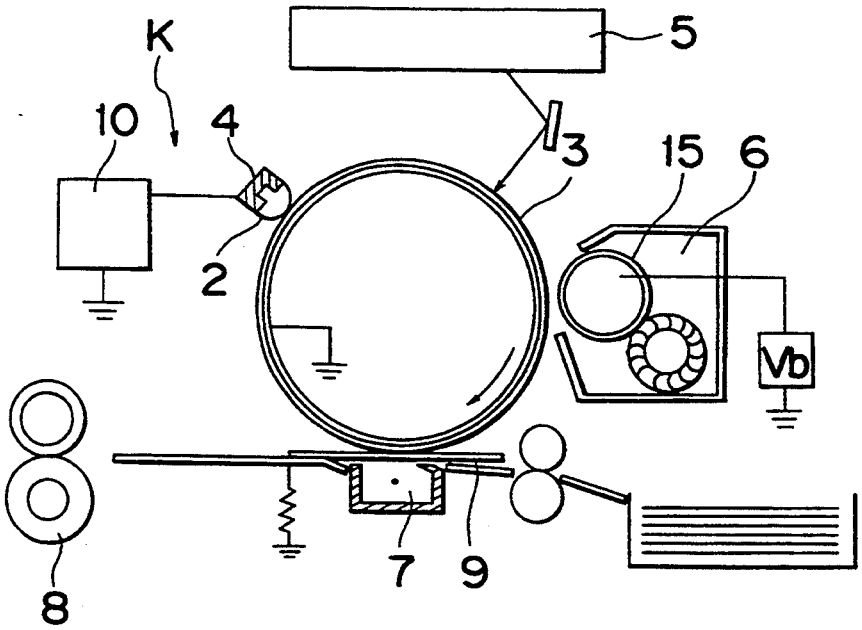
FIG. 3 is a schematic view of an electrophotographic apparatus incorporating the charging device of FIG. 1.

FIG. 3 shows an electrophotographic apparatus incorporating the charging device K. The electrophotographic apparatus includes the photosensitive drum 3, the charging device K, an exposure device 5, a developing device 6, a transfer device 7 and a fixing device 8. The charging device K includes the charging member 4 referred to above and a power source 10 for applying voltage to the charging member 4. Reference numeral 9 denotes a copy paper sheet.

Figure 4A:
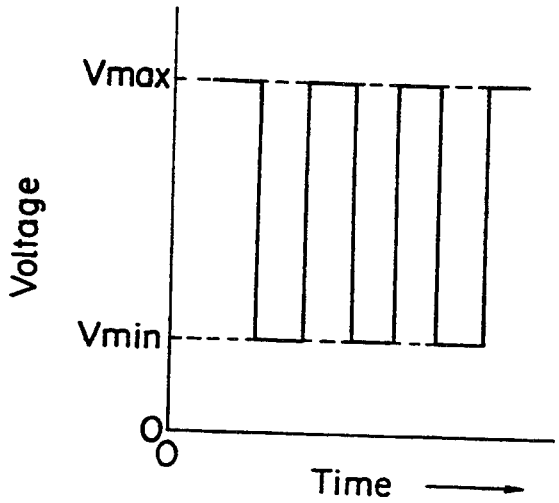
FIGS. 4*a* and 4*b* are graphs showing waveforms of the voltage applied to the charging member of FIG. 1.

Operation of the charging device K is described with reference to FIG. 3. Initially, the photosensitive drum 3 is charged by the charging member 4. Pulse voltage is applied to the charging member 4 by the power source 10. More specifically, in case the photosensitive drum 3 is of the negative charging type, a voltage of rectangular waves having a zero-to-peak value of −1000 to −2000 V is applied to the charging member 4 as shown in FIG. 4*a*. The voltage has a pulse frequency of 1 to 2000 Hz preferably and 100 to 200 Hz more preferably. When the photosensitive drum 3 is of the negative charging type, care should be exercised not to set the voltage of the power source 10 to a positive polarity for the following reason. Namely, in the case where reversal development is performed by using the photosensitive drum 3 charged to a negative polarity and toner charged to negative polarity when the voltage has a positive polarity, the voltage and the toner have opposite polarities and thus, the charging member 4 is readily dirtied by the toner by electrostatic attractive force. Application of the pulse voltage has for its objects to charge the surface of the photosensitive drum 3 uniformly and restrains adherence of the toner to the charging wire 2 through application of an oscillating electric field. Meanwhile, the toner adheres to the surface of the photosensitive drum by electrostatic force and its relatively large inter-molecular force. Application of the pulse voltage is also designed to reduce this inter-molecular force such that the toner readily vibrates or moves. When the charging wire 2 is made of an amorphous material having low energy loss as described above, production of self eddy current is restricted and the pulse voltage is transmitted efficiently.

Figure 4B:
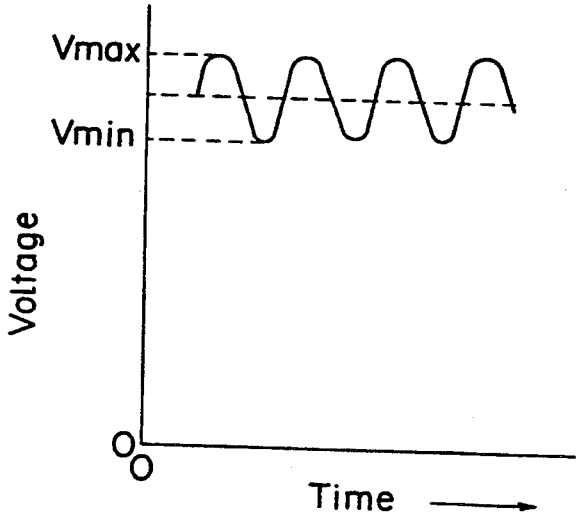

FIGS. 4*a* and 4*b* show waveforms of the pulse voltage employed in this embodiment. The pulse voltage has a minimum value Vmin of −50 V and a maximum value Vmax of −650 V. Meanwhile, the voltage has a pulse frequency of 100 Hz. At this time, the photosensitive drum 3 has a surface potential of about 500 V. When the voltage has a pulse frequency of about 1000 Hz, sine waves may be employed in place of the rectangular waves as shown in FIG. 4*b*. When the voltage has sine waves, it is preferable that its DC component is about 650 V and its AC component has a peak-to-peak value of about 100 V (=Vmax−Vmin). Since the charging wire 2 and the photosensitive drum 3 are held in contact with each other at the region A as shown in FIG. 2, the amplitude of AC to be applied may be small. However, if a gap defined between the charging wire 2 and the surface of the photosensitive drum 3 in the vicinity of the region A is large, the amplitude of AC should be increased.

After the photosensitive drum 3 has been charged by the charging member 4, exposure of an image is performed by the exposure device 5 so as to form a latent image on the photosensitive drum 3. Then, the latent image is developed into a visual image by the developing device 6. One-component developer or two-component developer may be used in the developing device 6. Furthermore, the developing device 6 may be of the contact type in which the developing device 6 is held in contact with the photosensitive drum 3 or of the non-contact type in which the developing device 6 is held out of contact with the photosensitive drum 3. Meanwhile, the toner may be magnetic or non-magnetic. The toner is transferred by the transfer device 7 onto the copy paper sheet 9 fed in response to an image signal. Any one of Corotron type, belt transfer type and roller transfer type devices may be adopted for the transfer device 7. The toner on the copy paper sheet 9 is fixed to the copy paper sheet 9 by the fixing device 8.

Meanwhile, a portion of the toner remains, as residual toner, on the photosensitive drum 3 without being transferred onto the copy paper sheet 9 by the transfer device 7. When the photosensitive drum 3 reaches the charging member 4 again through its rotation, the residual toner on the photosensitive drum 3 is shifted from the original position by the charging wire 2 inclined at the angle $\theta$ less than 90° relative to the axial direction of the photosensitive drum 3 and at the same time, the photosensitive drum 3 is charged. Since only electric charge having the same polarity as that of the toner is supplied to the charging wire 2 and the interval d of the charging wire 2 is 3 mm, the toner is not piled on the charging wire 2. The semicircular shape of the charging wire 2 is designed to prevent the toner from being piled on the charging wire 2. When the photosensitive drum 3 is further rotated, image exposure is performed through the residual toner by the exposure device 5. Since the density of the residual toner is low, exposure is hardly affected adversely by the residual toner. If the photosensitive drum 3 is formed by a transparent tubular member and is exposed from inside of the transparent tubular member, such a problem is eliminated that an exposure portion of the photosensitive drum 3 is covered by the residual toner. The latent image formed on the photosensitive drum 3 by exposure is developed into the visual toner image by the developing device 6 through reversal development. Usually, a bias potential Vb higher than the surface potential Vo of the photosensitive drum 3 is applied to the developing device 6. When a portion of the photosensitive drum 3 charged by shifting the residual toner therefrom by the charging wire 2 is exposed by the exposure device 5, the surface potential Vo of the photosensitive drum 3 discharges to a potential VL. Since the bias potential Vb is higher than the potential VL, the toner adheres to the exposed portion of the photosensitive drum as an image portion. On the contrary; the toner does not adhere to an unexposed portion of the photosensitive drum 3 from the relationship of ($Vo > Vb$).

Furthermore, since the photosensitive drum 3 is charged by shifting the residual toner on the surface of the photosensitive drum 3, the photosensitive drum 3 has the same polarity as that of the toner and thus, the toner is readily collected by the developing device 6 by the repulsive force caused by the same polarity between the toner and the photosensitive drum 3.

In this embodiment, the developing device 6 is of noncontact type in which the developing device 6 is held out of contact with the photosensitive drum 3. In the developing device 6, a sleeve 15 for supplying the toner to the surface of the photosensitive drum 3 is disposed most adjacent to the surface of the photosensitive drum 3 and is spaced 350 $\mu$m from the surface of the photosensitive drum 3. The bias potential Vb is set to $-350$ V and magnetic toner is employed for the developing device 6.

After the development step, the visual toner image is transferred onto the copy paper sheet 9 by the transfer device 7 of the Corotron type. As a result, an image is formed having a quality not inferior to that of an ordinary electrophotographic process including charging, exposure, development, transfer and cleaning steps. By using the charging device K of the present invention, the toner can be collected from an image nonforming portion of the photosensitive drum 3 efficiently. Thus, in addition to the above mentioned electrophotographic transfer method, a physical adsorption method using silicone resin, oil, rubber, etc. may also be employed in the transfer step subsequent to the development step. Alternatively, a heating portion of the fixing device 8 may be directly depressed against the photosensitive drum 3.

Figure 5:
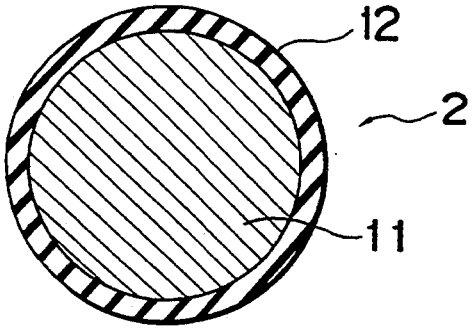
FIG. 5 is a sectional view of a charging wire of the charging member of FIG. 1.

FIG. 5 shows the charging wire 2 of the charging device K. The charging wire 2 includes an electrically conductive core 11 and an insulating coating layer 12 coated around the core 11. The core 11 may be made of metal such as stainless steel, aluminum, cobalt and tungsten or a synthetic fiber in which carbon or carbon fiber is scattered or is laminated around a core piece. In addition to metal having a high crystallinity, an amorphous metal may be used for the core 11. The coating layer 12 may be made of polyamide, urethane, polyethylene, silicone resin, fluororesin or alumina. The coating layer 12 has a thickness of 0.1 to 10 $\mu$m approximately. In order to effectively release the charging wire 2 from toner or substances contained in the toner, for example, magnetic powder, resinous powder and silica or papery powder contained in the copy paper sheet 9, the coating layer 12 will be desirably made of a silicone resin or fluororesin. As shown in FIGS. 1 and 2, this charging wire 2 is secured to the electrically conductive support member 1.

The coating layer 12 is provided for the following purpose. Usually, the photosensitive member is made of organic substance and has a photosensitive (photoconductive) layer of about 10 to 30 $\mu$m in thickness. During use, slightly uneven portions or voids due to papery powder may be produced on a surface of the photosensitive layer. In this case, if the charging wire 2 is formed by a single metallic element, charging is concentrated at the uneven portions or the voids, thereby resulting in unstable corona discharge. A corona charger in which high voltage is applied to a wire extended in a metallic casing is well known as corona discharge. A clearance of about 5 to 10 mm exists between the corona charger and the photosensitive layer to be charged and a voltage of about 5 to 6 kV is applied between the corona charger and the photosensitive layer. At this time, electric current of about 10 to 20 $\mu$A flows and a discharge resistance of about 500 to 1000 M$\Omega$ is present. Corona discharge slightly varies according to positive corona discharge and negative corona discharge. However, it is said that spark discharge is prevented by the discharge resistance, thus resulting in a stable corona discharge. Therefore, the coating layer 12 is provided for the purpose of forming, between the electrically conductive core 11 and the photosensitive layer, the discharge resistance for stabilizing corona discharge.

Figure 6:
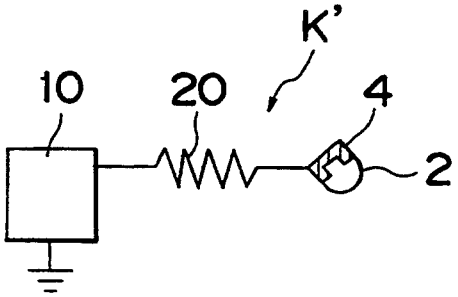
FIG. 6 is a schematic view showing a modification of the charging device of FIG. 3.

FIG. 6 shows a charging device K' which is a modification of the charging device K. In the charging device K', a resistance element 20 is connected between the charging member 4 and the power source 10 so as to eliminate local discharge at the uneven portions and the voids on the surface of the photosensitive drum 3, thereby resulting in uniform charging.

The voltage is applied to the charging wire 2 through the electrically conductive support member 1 having adjusted resistance. Meanwhile, the charging wire 2 is not required to be formed by a single continuous wire but a plurality of the wire sections 2*a* of the charging wire 2 are attached to the electrically conductive support member 1 separately. In this case, the wire sections 2*a* are independently brought into contact with the surface of the image bearing member at the small width of the region A. Therefore, even if a defect is partially present on the surface of the image bearing member, the influence of leak in the applied voltage is limited to the corresponding wire section 2*a* and thus, is not exerted on the charging wire 2 as a whole.

The coating layer 12 also serves to prevent toner or magnetic powder, resinous powder, silica, etc. contained in the toner from adhering to the charging wire 2. The toner usually has a particle size of several to 15 μm and therefore, is displaced on the photosensitive drum 3 by the charging wire 2 itself. However, magnetic powder, resinous powder, silica, etc. contained in the toner have a particle size smaller than that of the toner and thus, pass by or adhere to the charging wire 2. Therefore, in order to prevent adherence of these powders to the charging wire 2, it is effective that the coating layer 12 is made of silicone resin or fluororesin.

As is clear from the foregoing description, the wire sections 2*a* of the charging wire 2 are arranged at the proper interval d and form the angle $\theta$ less than 90° with the axial direction of the photosensitive drum 3 acting as the image bearing member so as to be brought into contact with the photosensitive drum 3. Furthermore, the pulse voltage having the polarity identical with the charged polarity of the toner is applied to the charging wire 2. Therefore, since not only the residual toner on the photosensitive drum 3 is shifted but the photosensitive drum 3 is charged by the charging wire 2, the toner can be collected at the developing device 6 and thus, the cleaning device can be eliminated from the electrophotographic apparatus. As a result, the charging device of the present invention lessens the quantity of produced ozone and makes the electrophotographic apparatus compact.

What is claimed is:

1. A charging member for charging a photosensitive member from above toner in an electrophotographic process in which charging, exposure, development, and transfer steps are performed repeatedly and in which a step of cleaning the toner remaining on the photosensitive member after the transfer step is eliminated, the charging member consisting:

an electrically conductive charging wire which is disposed in contact with the photosensitive member;

wherein the charging wire forms an angle of less than 90° with a direction of a rotational axis of the photosensitive member and is arranged at an interval in the direction of the rotational axis of the photosensitive member;

and wherein a pulse voltage having a polarity identical with that of the toner is applied to the charging wire so as to vibrate the toner.

2. A charging member for charging a photosensitive member from above toner in an electrophotographic process in which charging, exposure, development and transfer steps are performed repeatedly and in which a step of cleaning the toner remaining on the photosensitive member after the transfer step is eliminated, the charging member comprising:

an electrically conductive charging wire which has an electrically insulating coating layer on its surface brought into contact with the photosensitive member;

wherein the charging wire forms an angle of less than 90° with a direction of a rotational axis of the photosensitive member and is arranged at an interval in the direction of the rotational axis of the photosensitive member;

and wherein a pulse voltage having a polarity identical with that of the toner is applied to the charging wire so as to vibrate the toner.

3. A charging member for charging a photosensitive member from above toner in an electrophotographic process in which charging, exposure, development and transfer steps are performed repeatedly and in which a step of cleaning the toner remaining on the photosensitive member after the transfer step is eliminated, the charging member comprising:

an electrically conductive charging wire which has an electrically insulating coating layer on its periphery disposed in contact with the photosensitive member;

wherein the coating layer is of a material having high mold release effect on the toner;

wherein the charging wire forms an angle of less than 90° with a direction of a rotational axis of the photosensitive member and is arranged at an interval in the direction of the rotational axis of the photosensitive member;

and wherein a pulse voltage having a polarity identical with that of the toner is applied to the charging wire so as to vibrate the toner.

4. A charging device for use in an electrophotographic process in which charging, exposure, development and transfer steps are performed repeatedly and in which a step of cleaning toner remaining on a photosensitive member after the transfer step is eliminated, the charging device comprising:

a charging member for charging the photosensitive member from above the toner;

wherein the charging member includes an electrically conductive charging wire which is disposed in contact with the photosensitive member;

wherein the charging wire forms an angle of less than 90° with a direction of a rotational axis of the photosensitive member and is arranged at an interval in the direction of the rotational axis of the photosensitive member; and a power source for applying a pulse voltage to the charging wire through a resistance element, the pulse voltage having a polarity identical with that of the toner so as to vibrate the toner.

5. A charging device for use in an electrophotographic process in which charging, exposure, development and transfer steps are performed repeatedly and in which a step of cleaning toner remaining on a photosensitive member after the transfer step is eliminated, the charging device comprising:

a charging member for charging the photosensitive member from above the toner;

wherein the charging member includes an electrically conductive charging wire which has an electrically insulating coating layer on its periphery disposed in contact with the photosensitive member;

wherein the charging wire forms an angle of less than 90° with a direction of a rotational axis of the photosensitive member and is arranged at an interval in the direction of the rotational axis of the photosensitive member; and a power source for applying a pulse voltage to the charging wire through a resistance element, the pulse voltage having a polarity identical with that of the toner so as to vibrate the toner.

6. A charging device for use in an electrophotographic process in which charging, exposure, development and transfer steps are performed repeatedly and in which a step of cleaning toner remaining on a photosensitive member after the transfer step is eliminated, the charging device comprising:

a charging member for charging the photosensitive member from above the toner;

wherein the charging member includes a charging wire which is made of an electrically conductive amorphous metal and is disposed in contact with the photosensitive member;

wherein the charging wire forms an angle less than 90° with a direction of a rotational axis of the photosensitive member and is arranged at an interval in the direction of the rotational axis of the photosensitive member; and a power source for applying a pulse voltage to the charging wire, the pulse voltage having a polarity identical with that of the toner so as to vibrate the toner.

7. A charging device for use in an electrophotographic process in which charging, exposure, development and transfer steps are performed repeatedly and in which a step of cleaning toner remaining on a photosensitive member after the transfer step is eliminated, the charging device comprising:

a charging member for charging the photosensitive member from above the toner;

wherein the charging member includes a charging wire which is made of an electrically conductive amorphous metal and is disposed in contact with the photosensitive member;

wherein the charging wire forms an angle of less than 90° with a direction of a rotational axis of the photosensitive member and is arranged at an interval in the direction of the rotational axis of the photosensitive member; and a power source for applying a pulse voltage to the charging wire, through a resistance element, the pulse voltage having a polarity identical with that of the toner so as to vibrate the toner.

8. a charging member for charging a photosensitive member from above toner in an electrophotographic process in which charging, exposure, development and transfer steps are performed repeatedly and in which a step of cleaning the toner remaining on the photosensitive member after the transfer step is eliminated, the charging member comprising:

a plurality of electrically conductive charging wires which are disposed in contact with the photosensitive member;

wherein the charging wires form an angle of less than 90° with a direction of a rotational axis of the photosensitive member and are arranged at an interval in the direction of the rotational axis of the photosensitive member;

and wherein a pulse voltage having a polarity identical with that of the toner is applied to each of the charging wires so as to vibrate the toner.

* * * * *